US005895327A

United States Patent [19]

Francisco

[11] Patent Number: 5,895,327

[45] Date of Patent: Apr. 20, 1999

[54] GOLF SWING AID AND METHOD

[76] Inventor: Kent Francisco, 29820 Baden Pl., Malibu, Calif. 90265

[21] Appl. No.: 09/124,699

[22] Filed: Jul. 29, 1998

[51] Int. Cl.[6] ..... A63B 69/36

[52] U.S. Cl. ..... 473/229; 473/260; 473/409

[58] Field of Search ..... 473/229, 230, 473/257, 258, 259, 260, 409

[56] References Cited

U.S. PATENT DOCUMENTS

| | | | |
|---|---|---|---|
| 1,634,102 | 6/1927 | Hansen | 473/229 |
| 1,670,409 | 5/1928 | Hansen | 473/229 |
| 3,489,416 | 1/1970 | Mark | 473/229 |
| 3,711,103 | 1/1973 | Seltzer | 473/229 |
| 3,975,024 | 8/1976 | Stephan | 273/193 |
| 4,034,991 | 7/1977 | Oppenheimer | 273/186 |
| 4,071,251 | 1/1978 | Beckish | 273/186 |
| 4,583,738 | 4/1986 | Fava | 273/186 |
| 5,125,844 | 6/1992 | Grant et al. | 434/252 |
| 5,255,921 | 10/1993 | Spence | 273/187 |
| 5,334,028 | 8/1994 | Melligan | 434/252 |
| 5,417,420 | 5/1995 | Berg | 273/87.2 |
| 5,423,548 | 6/1995 | Bricker | 273/191 |
| 5,433,445 | 7/1995 | Melancon | 273/186.1 |
| 5,467,993 | 11/1995 | Higginson | 273/191 |
| 5,527,041 | 6/1996 | Terry | 473/150 |
| 5,628,695 | 5/1997 | Worthington et al. | 473/229 |
| 5,658,204 | 8/1997 | Nappi | 473/229 |

*Primary Examiner*—George J. Marlo
*Attorney, Agent, or Firm*—Cislo & Thomas LLP

[57] ABSTRACT

A golf swing aid constrains the swing of an associated headless golf club to provide a golf student with proper golf club swing notion. Flanged backswing and downswing rails are intermediated by a continuous curved rail and supported by a rail support. The curved shape of the rails is derived from the proper "inside out" professional-type golf swing and may be determined on a theoretical or experimental basis. A headless golf club has a rolling clevis that engages the flanged rails to roll thereupon. The golf student so engaging the headless golf club is then constrained in the golf swing to follow the shape of the rails. This requires the student to use the back muscles rather than the wrists, arms and shoulders to develop the proper swing action. The flanged rails have open ends so that when the point of impact is reached at the completion of the downswing, the student may follow through on the shot with the headless golf club leaving the downswing rail. The open end on the backswing rail then allows for quick reengagement of the backswing rail by the rolling clevis. The golf student may also benefit by visual contemplation of the shape of the golf swing aid of the present invention as visual memory will complement the muscle memory achieved through use of the present invention.

20 Claims, 10 Drawing Sheets

GOLF SWING AID AND METHOD

BACKGROUND OF THE INVENTION

1. Field of the Invention

The present invention generally relates to golf swing training devices, and more particularly to the type in which a student stands adjacent to the device and swings a golf club shaft, which maintains contact with a guide surface of the device.

2. Description of the Related Art

Golf is a simple game. The object is to hit a small ball into a small hole in the ground from distances of inches to several hundred yards. The balls are struck with a variety of clubs depending on the distance to the hole, where the hole is positioned on the green, and the ground surface conditions underneath the ball and on the green. The clubs vary in weight, shaft length and face angle. Since the object of the game is to get the ball in the cup in the fewest number of strokes over 18 holes, the ability to consistently strike the ball with a strong, controlled swing action is a highly desired trait. All professional golfers and a few gifted amateurs have such a swing, few others do.

Casual observation of touring professional golfers gives the impression that they all have different golf swings, but closer analysis proves this assumption wrong. What is disguised by the individual mannerisms of each player is the fact that they all have the same swing: an "inside out" swing that is controlled by the back of the golfer's body. This axiom is the basis for the present invention.

If one were to mark a spot on the shaft of any professional's golf club and then watch only that spot when the pro hits a shot, he would see that the club makes two distinct arcs: a separate one during the backswing and a separate one during the downswing. Connecting these two major arcs is a small backward drop in the loop that corresponds to the back of the body initiating the downswing by starting to unwind the hips. The arc of the club in the backswing is more vertical than that of the downswing and is generally aligned with the intended flight path of the ball. The arc of the downswing is less vertical and of a shorter radius than that of the backswing and is aligned slightly to the inside of the intended flight path. The professionals call this an "inside out" swing, and, unless they are intentionally playing a "slice", their club never approaches the ball from outside of the intended flight path of the ball.

The vast majority of people playing the game of golf, however, do not have a swing is action pattern that will allow them to approach the ball from the inside of its intended flight path. The amateur swing is an "outside in" swing. The amateur downswing is initiated in the front of the body by the hands, arms, or shoulders and the club approaches the ball from outside of the intended flight line. Just before impact, the amateur's hands will usually attempt to correct this problem by opening the clubface and the result is a "slice" of the unintentional variety. Over 90% of the people playing golf cannot complete a round in less than 100 strokes. The professional averages 71.5 strokes per round. With an "outside in" swing, the typical amateur just does not have a chance.

The professional has constructed, usually by trial and error at a very young age and often unknowingly, a patterned golf swing action based in the back of the body that will consistently repeat in all circumstances and situations. In golf, the foundation of this patterned action is in the body's back. The human body has been endowed with a dominant and powerful muscle structure in the back. The back also has a very strong and secure bone structure to support these active and vital muscles. To further reinforce this rear body capability, the back has been supplied with a solid stabilizing force that sustains the body's equilibrium: the spinal column which acts as an "axis" of the entire body. It is because of the presence of these powerful and stable structures that good balance and coordination are primarily determined by the back.

In all athletic activities, whether bowling, playing tennis, or throwing a baseball, the initial move made by the athlete is a "turn into the back". Right from the outset of the motion, the athlete transfers the object that he is rolling, stroking, or throwing into his back or behind him. When hitting a baseball or shooting a hockey puck, the hands are placed well around to the back of the body at the starting position. The best athletes have learned to use the back of the body to swing the arms.

The distance between the hand-held object (bowling ball, tennis racket, baseball, etc.) and the powerful back muscles creates an extended moment between the turning source (the back) and the action object (the bowling ball, etc.). This distance enables the athlete to transmit a greater angular momentum to the action object, creating greater force or velocity. Consequently, by making controlled use of the back muscles, the athlete brings more power to the game.

The same is true in golf. The professional golfer has learned to think of the club head, hands and arms as mere extensions of the body; they are not allowed to make independent actions of their own. All professionals utilize a one-piece body swing that keeps the club head and hand action captives of a proper body rotation. During the downswing, the return to the ball is initiated from the back with the hips and legs. The arms and shoulders remain steady as if securely fastened to the back throughout the entire swing action. As the hips and big muscles of the back turn round and through to the ball, the arms, hands and club are then powerfully released at the ball in a definite "inside out" path.

The average golfer cannot conceive of turning the club from the back of the body because the hands and arms are felt to be so securely fastened to the club in front. Therefore, the club is swung around from the front of the body with the arms and shoulders instead of properly winding from the back. This type of incorrect turn places the body in a very poor position to return the club properly to the ball. It creates a hacking action rather than a swinging dynamic. As the body turns back to the ball from the front it causes the club to swing around from outside of the intended flight line of the ball. This outside swing action is the cause of the dreaded "slice".

SUMMARY OF THE INVENTION

The present invention is a continuous loop of tubular material representing the backswing and the downswing of a professional golfer. The loop traces the three-dimensional movement of a point on a professional's golf club shaft (12 inches up from the head of the club) from setup through impact. The backswing loop starts at the right side of the ball and flows up to the top of the swing where a short backward drop initiates the downswing loop, which returns back to the point of impact. The loop is suspended in the correct three-dimensional relationship by adjustable vertical supports attached to a base on the ground. The student stands within the curve of the loop and holds the grip of a shortened golf club that is attached to a guide track in the loop. As the student swings the club through the backswing and downswing, the guide track in the loop moves the student through the "inside out" swing action pattern that the professional always makes.

The current invention both visually and physically reinforces the amateur's construction of a consistent and correct golf swing action. The device visually reinforces the building of the, desired swing action because it is an actual three-dimensional replication of a professional "inside out" swing. Unlike all prior art, the student is actually given a picture of the professional's swing from setup to impact. The student obtains both a physical and visual blueprint for the "inside out" swing action pattern.

The device physically reinforces the performance of the correct swing action pattern because it keeps the student's arms and shoulders securely positioned with respect to the back of the body during the entire swing action. By following the guide track in the loop, the student is prevented from swinging the golf club around the front of the body with the arms and shoulders. The focus of both the backswing and the downswing is the back of the body. This reinforces the student's ability to operate and use the big back muscles. Unlike all prior art, the student is required to use the back of the body to swing the arms. The student actually experiences an "inside out" swing action pattern.

The present invention provides the student with both a fill-scale visual template and a physical muscle memory-trail guide. By seeing the correct swing and practicing the correct swing, the student will ultimately be able to build in a proper and powerful swing action. One that the student will repeat and which will function satisfactorily from swing to swing.

By constructing a mirror image of the present invention, the left-handed golf student may also practice this professional-type golf swing.

OBJECTS OF THE INVENTION

It is an object of the present invention to provide a golf swing aid that instructs a golf student to perform proper backswings and downswings.

It is another object of the present invention to provide a golf swing aid that allows the development of muscle memory for a proper golf swing.

It is yet another object of the present invention to provide an object that shows in physical form the motion of a proper golf swing including the backswing and the downswing.

These and other objects and advantages of the present invention will be apparent from a review of the following specification and accompanying drawings.

DESCRIPTION OF THE PREFERRED EMBODIMENT(S)

Figure 1:
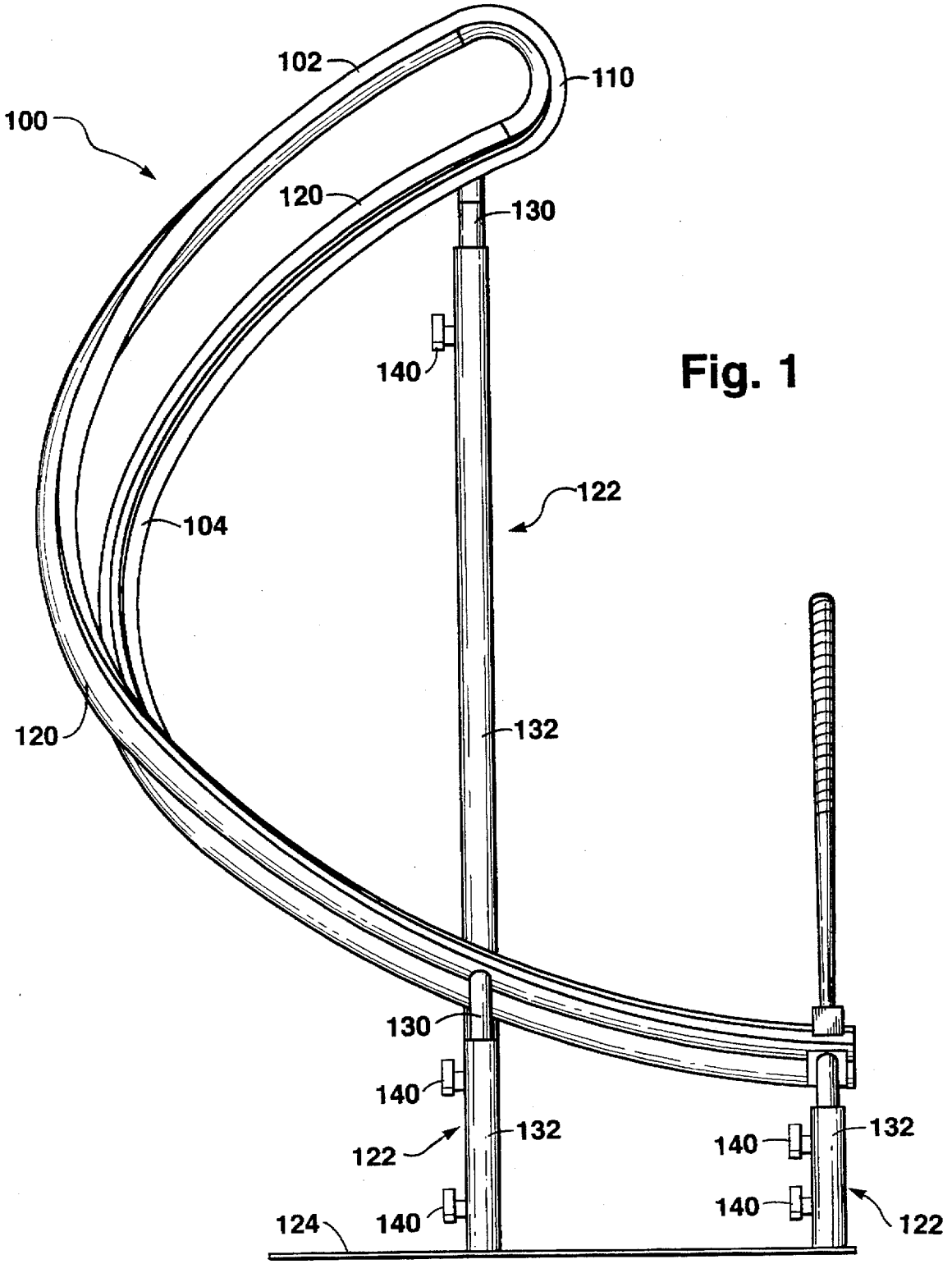
FIG. 1 is a front elevational view of the golf swing aid of the present invention.
Figure 2:
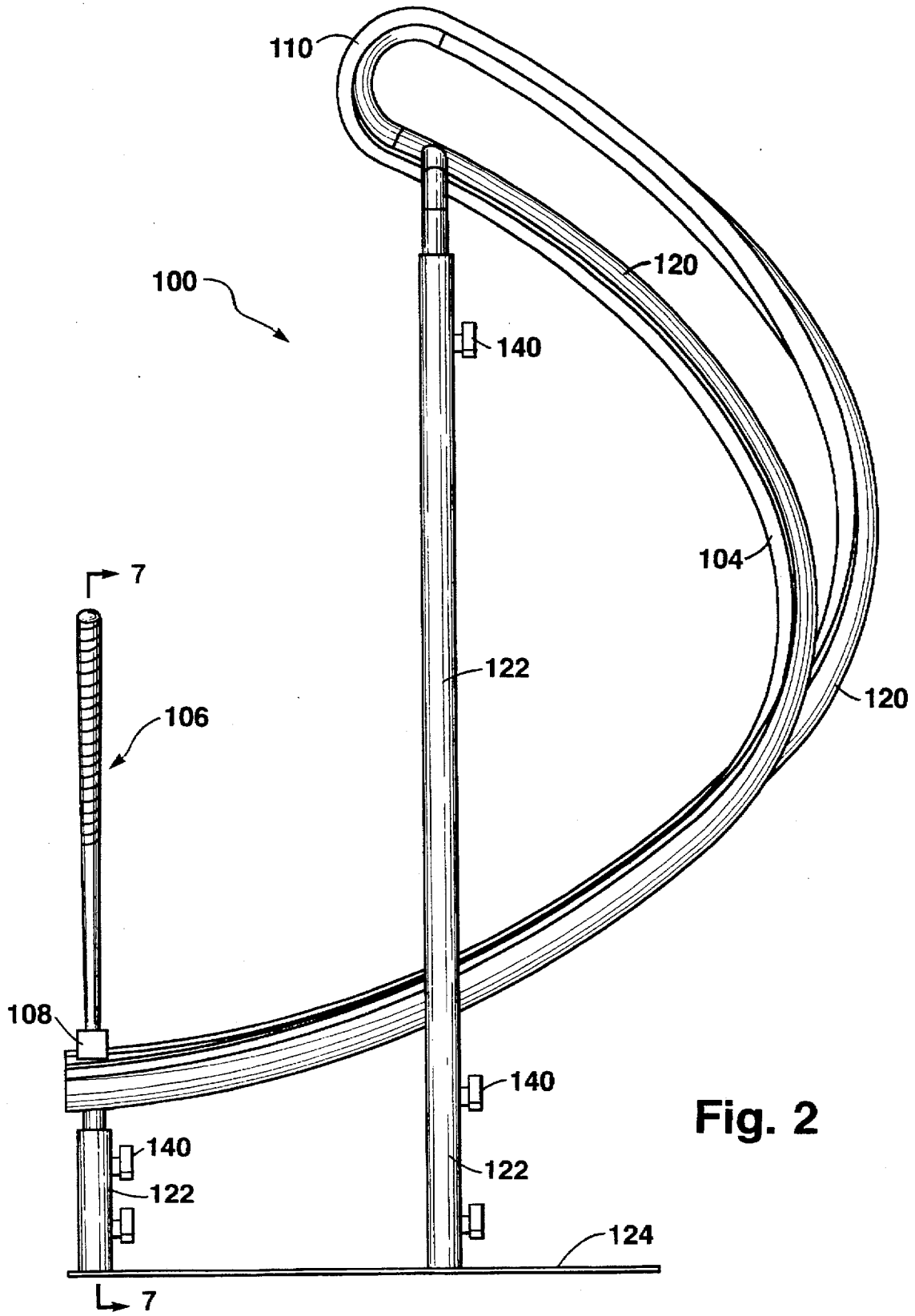
FIG. 2 is a rear elevational view of the golf swing aid of FIG. 1.

The detailed description set forth below in connection with the appended drawings is intended as a description of a presently preferred embodiment of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequence may be accomplished by different embodiments that are also intended to be encompassed within the spirit and scope of the invention.

As shown in FIGS. 1 through 6, the golf swing aid 100 of the present invention has a first backswing rail 102 and a second downswing rail 104. A headless golf club 106 is slidably attached by a rolling clevis 108 to the backswing rail 102. The backswing rail 102 is connected by a short curved section 110 to the downswing rail 104. The headless golf club 106 travels continuously along the first backswing rail 102 where it meets the intermediating curve 110 to travel during the downswing along the downswing rail 104.

Figure 5:
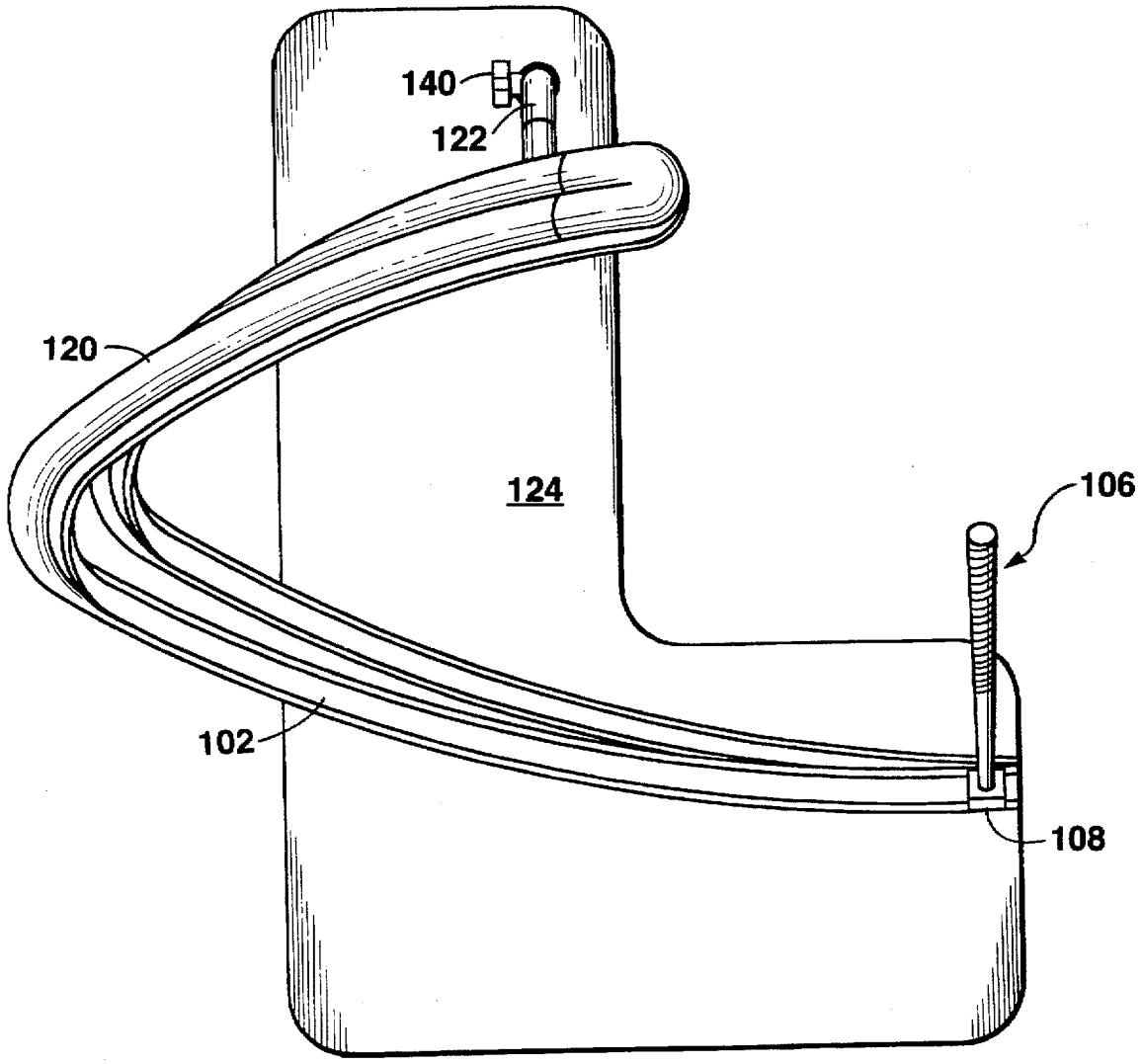
FIG. 5 is a top view of the golf swing aid of FIG. 1.
Figure 6:
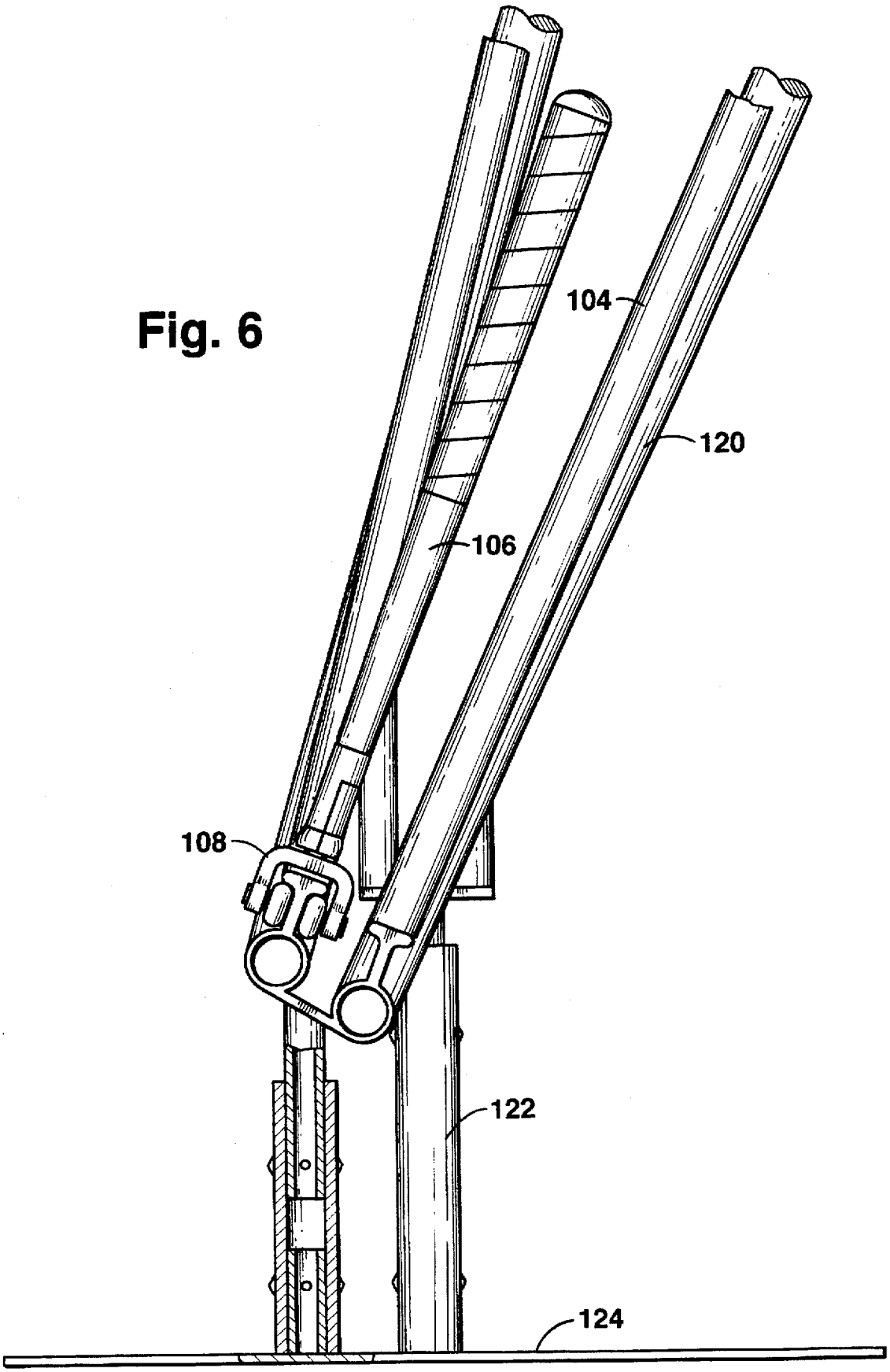
FIG. 6 is a left side cross-sectional view taken along line 6—6 of FIG. 1.

The backswing and downswing rails 102, 104 are supported by a rail support 120 which also serves to support the intermediating curved rail portion 110. The rail support 120 supports the rails 102, 104 up and away from adjustable vertical supports 122 as well as providing mechanical support for the rails. A base 124 provides a stable support for the adjustable vertical supports 122 and ultimately the rail support 120 and rails 102, 104. The base is best shown in FIG. 5 where it may take somewhat of an "L" shape. However, other configurations of support can be established for the present invention as the main emphasis is upon the backswing rail 102 and the downswing rail 104 which serve to guide and control the golf student's golf swing.

As is known in the art (due to the long and historical nature of the game of golf), the best golf shots are those generated by the muscles of the back using the body as a pendulum with the arms extended to whip the golf club head around to forcefully and controllably collide with and give flight to the golf ball. The arcs described by the backswing rail 102 and the downswing rail 104 conform to the preferred paths to be taken by a golf club shaft at the location of the rolling clevis 108.

Generally, the back muscles are wound like a coiled spring then unleashed to swing the golf club rapidly back to the ball. The path taken by the backswing rail 102 reflects the initial coiling of the back muscles with the golfer's weight shifting to the foot away from the shot. This is otherwise known as the back foot. At the top of the backswing, the golfer braces the front foot, starts turning the hips and uncoiling the back muscles. This causes the downswing arc to be less vertical. The curved continuity rail 110 intermediates the travel of the headless golf club 106 as it makes a transition from the backswing rail 102 to the downswing rail 104. As the body pulls on the drag that is the golf club, the golf club head and the golf club shaft dip down slightly (during the shot). The lower attitude of the downswing rail 104 with respect to the backswing rail 102 reflects this.

The radii of curvature for the backswing rail 102 and the downswing rail 104 are similar but not identical. These radii of curvature, generally one for the backswing rail 102 and a separate one for the downswing rail 104, reflect the diverse nature of the pivoting centers arising from the golf club swing. These pivoting centers include: the hips, the shoulders, the elbows, and the wrists, as well as the knees and ankles, namely all of the articulable and pivotable joints of the body. The same factors are similarly true for the downswing rail 104 as for the backswing rail 102 save that the disposition of the golf club changes to accommodate the changeover from the golf club shaft pushing the golf club head up during the backswing and pulling it down during the downswing.

Two types of mechanical adjustments are contemplated in the present invention. Golfer arm length will be accounted for by using headless golf clubs 106 of several different lengths. This will allow for correct positioning with respect to the radii of the curvature of the arcs. Golfers of different heights will be able to raise or lower the adjustable vertical supports 122. This will raise or lower the height of the backswing and downswing rails 102, 104 as a whole.

The curves realized in the backswing 102 and downswing 104 rails may be obtained from swings of professional golfers or theoretical best swings published in the literature. Stop action photography or the like can indicate to fabrication engineers how to properly construct the curve of the backswing rail 102 and the downswing rail 104. The same is similarly true for the intermediating curve rail 110.

Telescoping pipes 130 fit within upstanding pipes 132 in order to provide the adjustable vertical support 122. The telescoping pipes 132 may have threaded holes drilled into them. Thumb screws or the like 140 are used to secure the telescoping pipes 130 to the upstanding pipes 140. In one embodiment of the present invention, heights may be marked on each of the telescoping pipes 130 so that the proper height is obtained by the golf swing aid 100 for a golfer of a particular height.

In fact, the markings on the telescoping pipes 130 can reflect the height of the golfer. For example, the telescoping pipes 130 could be marked at the appropriate height for a golfer six feet four inches tall. Upon appropriately adjusting the rails 102, 104, the thumbscrews 140 are secured in place to hold the rails 120, 104 in place.

In an alternative embodiment, the telescoping pipes 130 may have a slot cut into them that accommodates the pins of the threaded thumbscrews 140. En such an embodiment, a bolt head or nut wider than the slot of the telescoping pipes 130 serves to secure the telescoping pipes 130 to the upstanding pipes 132 as the telescoping pipes 130 are compressed between the head of the threaded thumbscrew 140 and the nut.

As explained in more detail below, the headless golf club 106 rolls upon the rails 102, 104 by means of the rolling clevis 108. The weight of the rolling clevis 108 will be minimal so that a light pulling pressure on the rails 102, 104, may easily be maintained during the slow, muscle memory training practice swings. This will allow for full concentration on the driving force of the swing: the back. The headless golf club 106 may pivot upon the rolling clevis 108 to allow proper articulation during the backswing and the downswing.

In an alternative embodiment of the present invention, the rolling clevis 108 may be appropriately weighted to reflect the weight absent from the headless golf club that would otherwise be there with a regular golf club having a regular golf head. This might help the student better simulate the swing of a natural golf club.

The rails 102, 104 may be easily and economically constructed by having an element with uniform T-shaped cross section welded, affixed, or fastened to the tubular piping rail support 120. The rails 102, 104 and the rail support 120 may also be constructed as unitary extruded elements. Care should be taken in constructing the present invention as a uniform T-shaped cross section enables better performance.

Alternatively, in order to provide a flexible rail, construction of the present invention could be achieved as follows. By providing a properly curved rail support conforming to the present invention, a plastic or other sufficiently-resilient rail could be formed having a flexible ring at its base. The ring could be incomplete to form a slot through which the rail support would fit. The flexible ring would have a diameter on the order of the rail support diameter. The rail could then be fixed to the rail support by snap fitting the rail ring over the rail support. Adhesive such as fiberglass or the like could be used to cement or otherwise hold the rail to the rail support.

In an alternative embodiment of the present invention, highly magnetic rail means might be used in conjunction with a highly magnetic end for headless golf club. The highly magnetic end of the headless golf club could replace the rolling clevis 108 in the present invention. Having both the rail and club end of the same polarity would cause the two to repel, keeping the headless club end generally away from the rail. When properly balanced, the headless golf club would be able to engage the rail in a generally friction less manner. For example, if the rails were generally tubular and the headless golf club end generally ring shaped, the headless golf club end could travel along the rail with little friction.

Having described above the golf swing aid 100 with respect to the general construction of the rails 102, 104 and the like, detailed description is now made of the headless golf club and, particularly, the rolling clevis 108. FIGS. 7–11 show in detail the headless golf club 106 with its rolling clevis 108.

Figure 7:
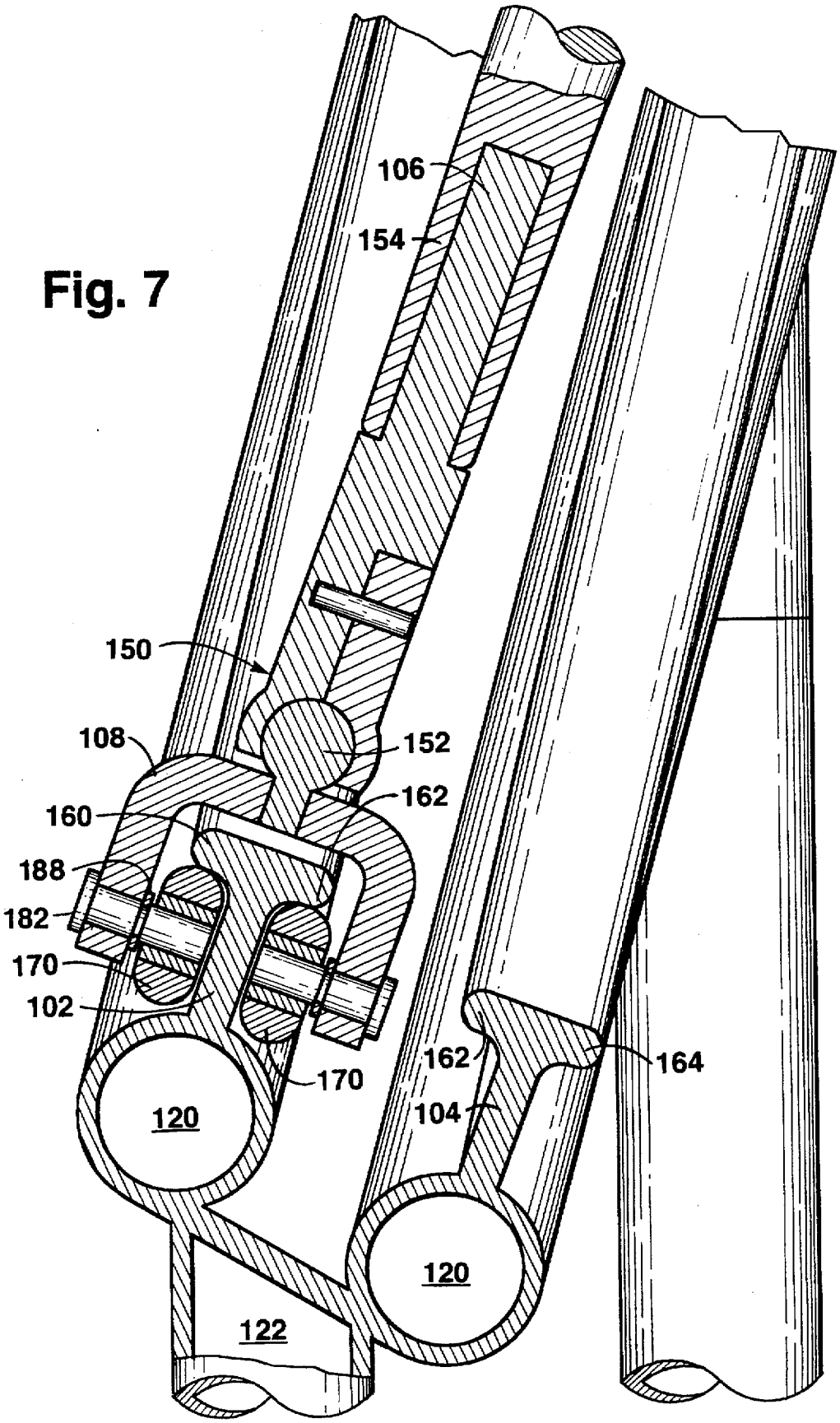
FIG. 7 is an enlarged cross-sectional view of the encircled portion 7 of FIG. 6.
Figure 8:
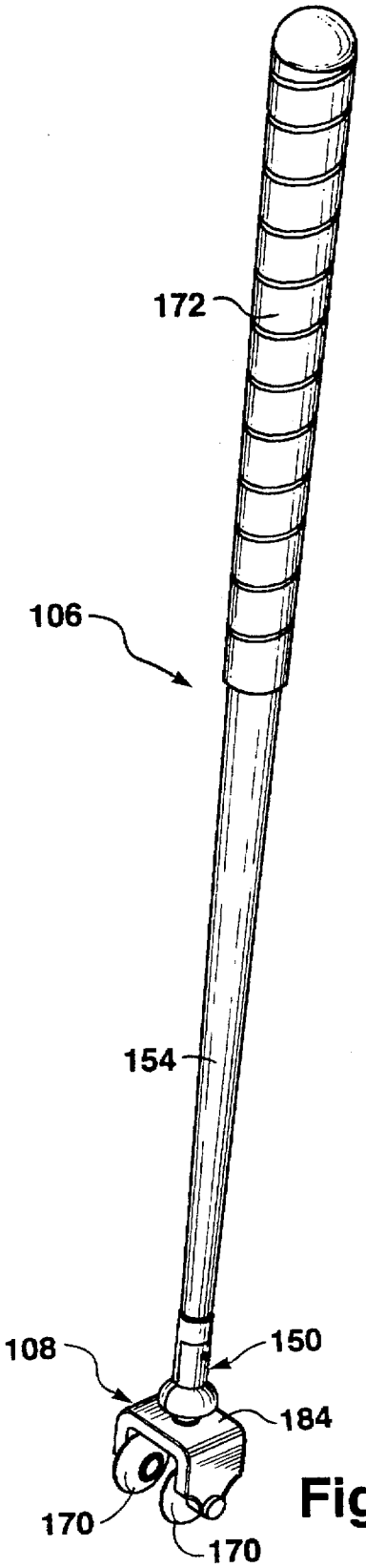
FIG. 8 is a side perspective view of the headless golf club of the present invention.
Figure 9:
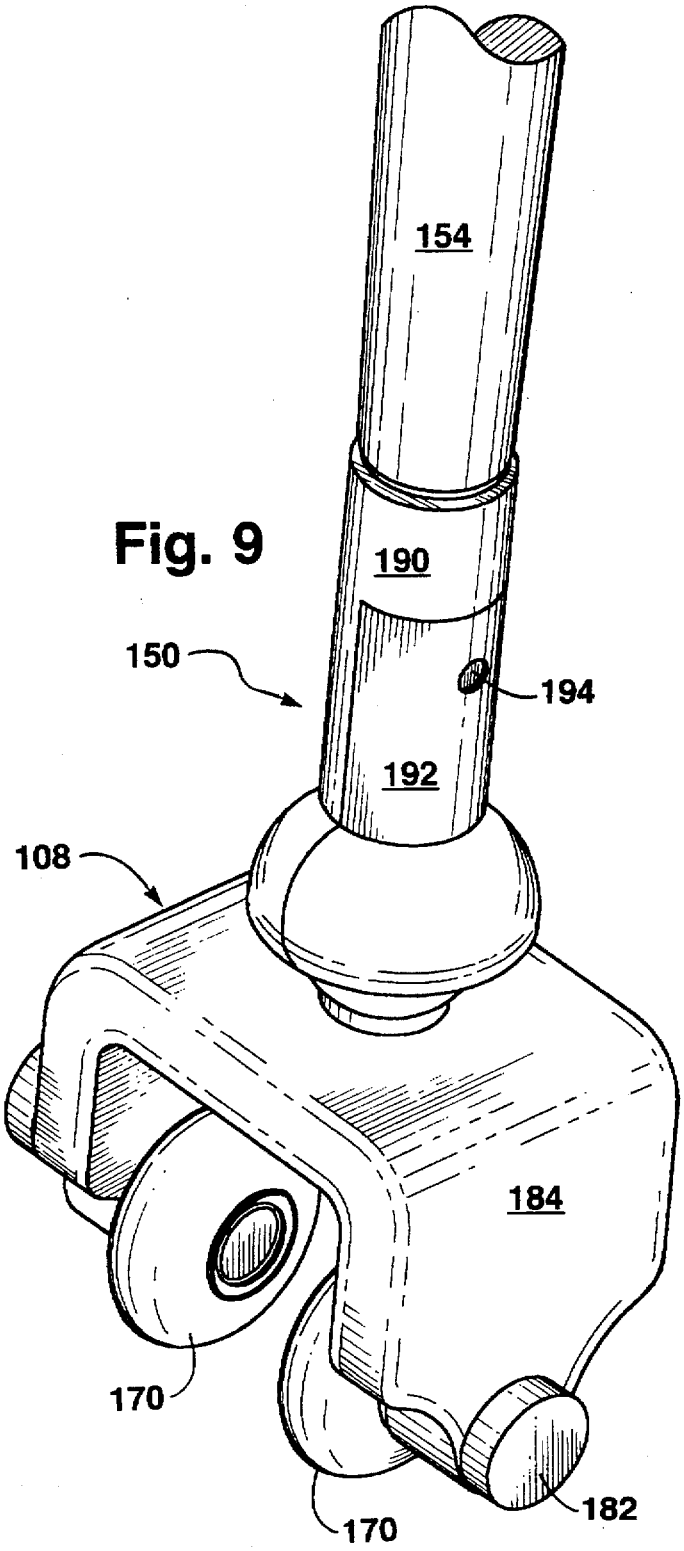
FIG. 9 is an enlarged view of the rolling clevis and connection section of the headless golf club of FIG. 8.
Figure 10:
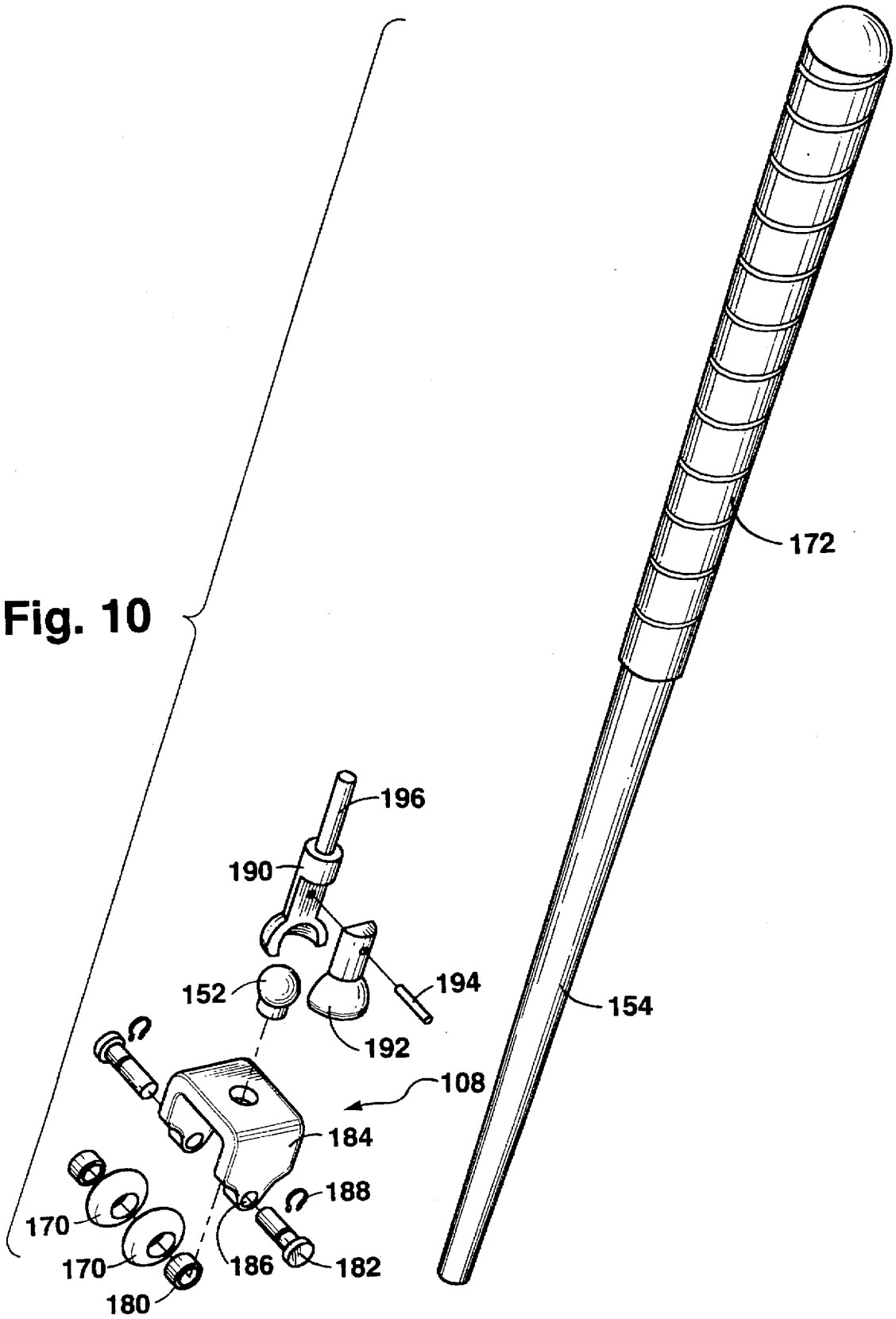
FIG. 10 is a side perspective and exploded view of the headless golf club of FIG. 8.

FIG. 7 shows in detail the engagement of the rolling clevis 108 with the backswing rail 102. In FIG. 7, the headless golf club 106 has a socket 108 which engages a swivel ball 152, forming a ball and socket joint junction between the shaft 154 of the headless golf club 106 and the rolling clevis 108.

Figure 3:
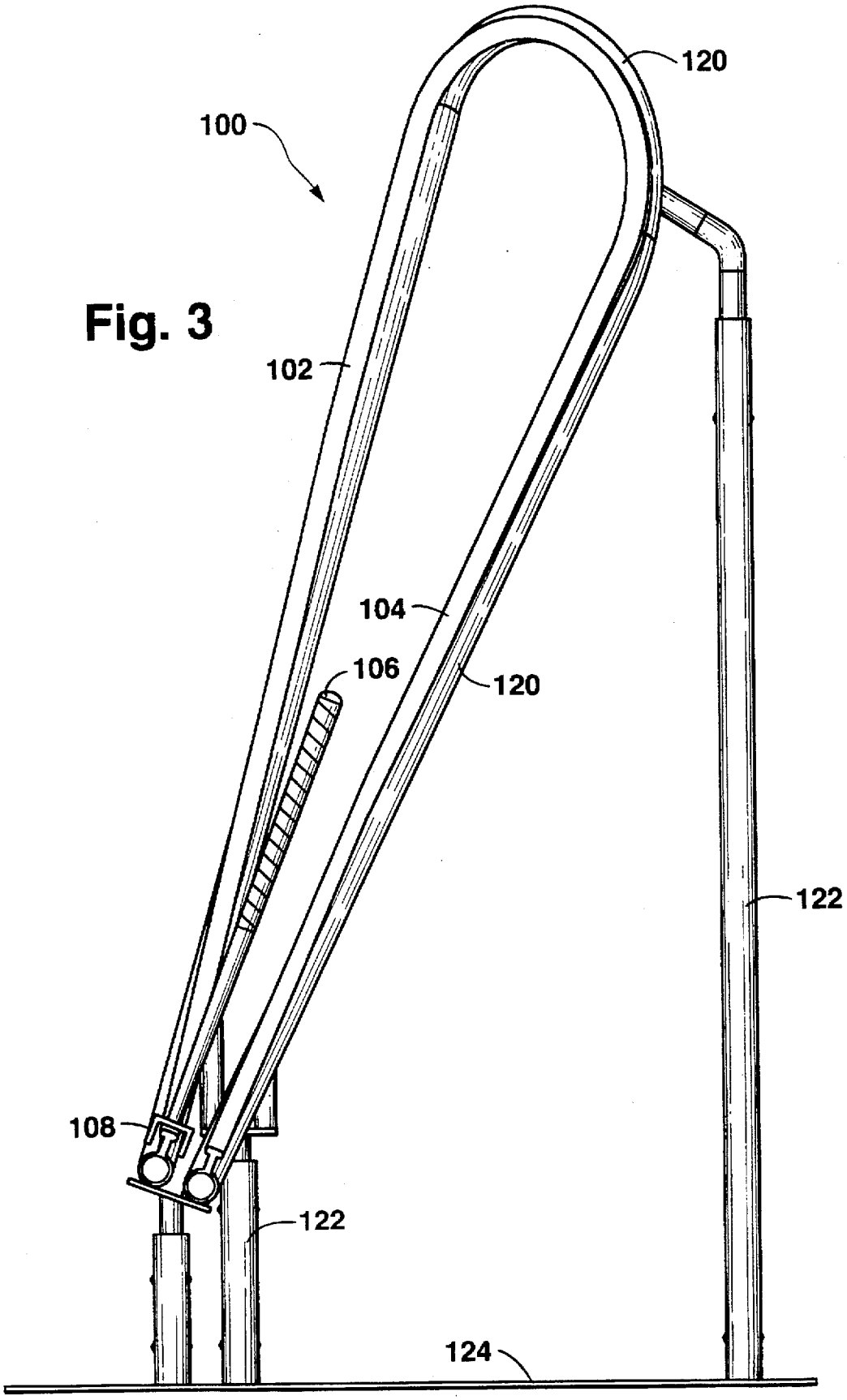
FIG. 3 is a left elevational view of the golf swing aid of FIG. 1.
Figure 4:
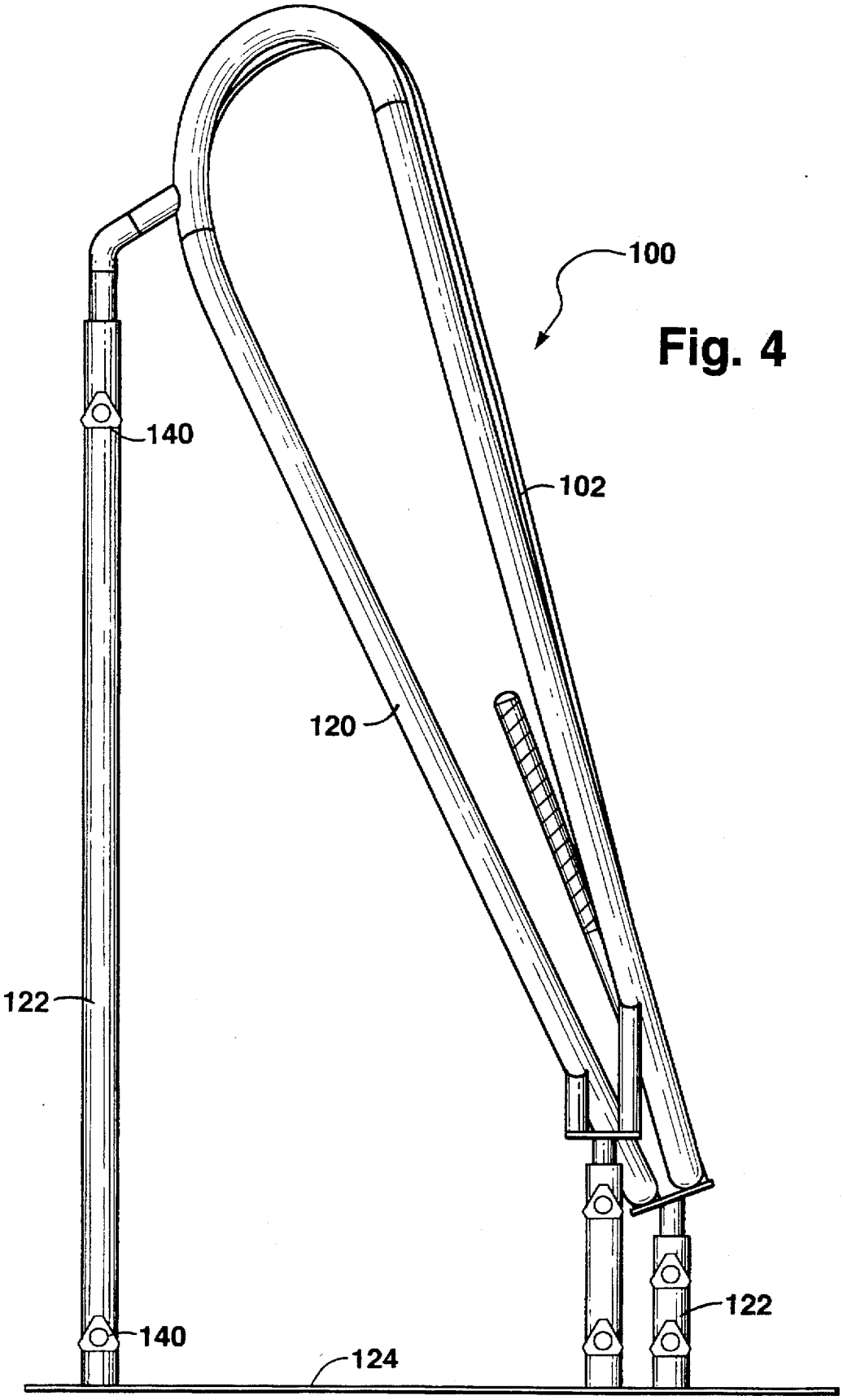
FIG. 4 is a right elevational view of the golf swing aid of FIG. 1.

Each of the rails 102, 104 is flanged at its upper end. Specifically, the backswing rail 102 has protruding flanges 160, 162, while the downswing rail 104 has flanges 164, 166. The flanges trap rollers 170 between themselves and the rail support 120. However, as shown in FIGS. 3 and 7, the ends of the rails open out and allow the rolling clevis 108 to disengage from either rail 102, 104.

The ability of the rolling clevis 108 to disengage from the downswing rail 104 is especially advantageous as it allows the student to follow through on the golf swing. As shown in the drawings, the headless golf club 106 also has a handle with a grip 172.

Figure 11:
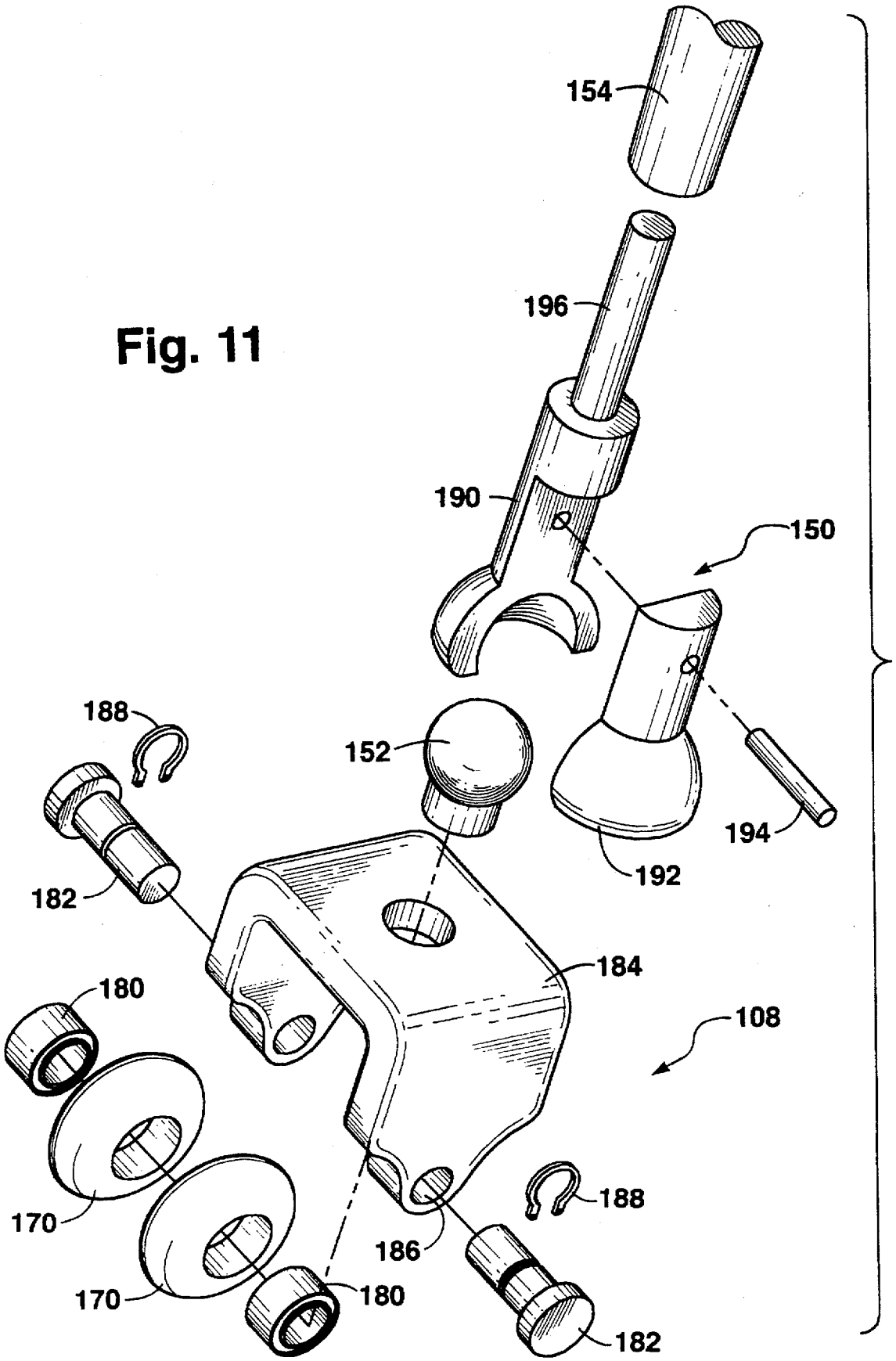
FIG. 11 is an exploded view of the rolling clevis and connection of the headless golf club of FIG. 8.

FIG. 11 shows an exploded view of the rolling clevis 108. The rollers 170 have an internal roller bearing 180 that turns upon an axle pin 182. The axle pin 182 fits into a clevis 184 through an aperture 186 thereof. A snap ring 188 serves to hold the axle pin 182 in place. Consequently, the roller 170 is likewise held in place due to the stability of the axle pin 182. As shown in the drawings, two rollers 170 are used, one on either side of the rails 102, 104.

As shown in FIG. 11, a swivel ball 152 is fitted atop the clevis 184 and is held in place by a socket 150 formed by first swivel half 190 in conjunction with a second swivel half 192. The two socket halves 190, 192 are held together by a locking pin 194. The socket formed by the socket 150 is such that it holds the swivel ball 152 in place in the socket 150. The socket 150 formed by the two socket halves 190, 192 may engage the swivel ball 152 past its widest circumference so that the swivel ball 152 is trapped within the socket 150.

An extending shaft 196 may extend from the socket 150 in order to provide appropriate engagement with the headless golf club shaft 154. In an alternative embodiment, the extending shaft 196 may be engaged as by a spring or otherwise with the headless golf club shaft 154 to provide some margin of extension between the extending socket shaft 196 and the headless golf club shaft 154.

As additional enhancements to the present invention, Delrin® and/or Teflon® may be used to provide a low-friction and durable interface between the rails 102, 104 and the rolling clevis 108 of the headless golf club 106. Alternatively, it may be possible to achieve magnetic coupling between the rails 102, 104 and the headless golf club head 106. A magnetic strip may be used in conjunction with a charged track to establish an attractive coupling between the rails 102, 104 and the headless golf club 106.

Having set forth above the construction of the golf swing aid 150 and the headless golf club 106, the operation of the golf swing aid 100 of the present invention is generally understood with some ease as the form of the golf swing aid 100 follows its function.

After constructing the golf swing aid 100 of the present invention, or otherwise providing it to the student, the student engages the headless golf club 106 by grasping the upper portion of the shaft at the grip 172 with the hands in their normal ball striking grip. The student then begins the shot by rolling the rolling clevis 108 along the backswing rail 102. Upon reaching the end of the backswing rail 102 the rolling clevis 108 then travels upon the intermediating continuing curve 110 as the backswing is completed and the ball striking portion of the golf swing begins. The rolling clevis 108 then travels onto the downswing rail 104 and the student is guided by the downswing rail 104 through the "inside out" professional-type golf swing. At the point of impact, the rolling clevis 108 may leave the downswing rail 104 allowing the student to follow through on the shot. If another swing is desired, the rolling clevis 108 and the headless golf club 106 will easily re-engage the open end portion of the backswing rail 102. The course of the student's swing is constrained by the rails 102, 104, requiring the student to engage in the desirable inside out swing action pattern. This professional-type move is a product of the coiling and uncoiling motion of the back and the limited emphasis on the use of hands, arms and shoulders during the swing.

While the present invention has been described with regards to certain particular embodiments, it is recognized that additional variations of the present invention may be devised without departing from the inventive concept. For example, to build a golf swing with either a flatter or more vertical set of backswing and downswing arcs, the backswing 102 and downswing 104 rails may be adjusted to form the desired swing pattern. Or if a larger or smaller transitional loop between the backswing and downswing is needed, the imtermediating continuing curve 110 may be increased or decreased in size. If the golf student likes using a particular brand of golf club grip, the shaft of the headless golf club 106 can easily be regripped with the preferred grip.

What is claimed is:

1. A golf swing aid for instruction of a proper golf swing, comprising:

a first curved track, said first curved track curved in a shape of a proper backswing;

a second curved track, said second curved track curved in a shape of a proper downswing and dishaped downwardly and posteriorly from said first curved track; and a third curved track, said third curved track downwardly and posteriorly coupling said first curved track in a continuous manner to said second curved track; whereby a golf student can practice proper backswings and downswings to achieve a proper golf swing.

2. The golf swing aid of claim 1, further comprising:

a headless golf club, said headless golf club slidably coupled to said curved tracks; whereby said golf student can practice said proper backswings and downswings by engaging and swinging said headless golf club along said curved tracks.

3. The golf swing aid of claim 2, further comprising:

said first curved track having a first flange;

said second curved track having a second flange; and said first flange coupled continuously with said second flange; whereby said headless golf club engages said first and second flanges to restrict travel of said headless golf club to a path along said curved tracks.

4. The golf swing aid of claim 3, wherein said headless golf club further comprises:

a rolling clevis, said rolling clevis engaging one of said first and second flanges, said rolling clevis restricting travel of said headless golf club to said path along said curved tracks.

5. The golf swing aid of claim 4, wherein said rolling clevis further comprises:

a rolling clevis weighing less than or approximately the same as a golf club head to substitute therefor and to deliver proper tactile and inertial response; whereby a light pulling pressure on the tracks may easily be maintained during the slow, muscle memory training practice swings allowing full concentration on the muscles and position of the golfer's back.

6. The golf swing aid of claim 5, further comprising:

a vertical support, said vertical support supporting one of said curved tracks at an appropriate height for said golf student.

7. The golf swing aid of claim 6, wherein said vertical support further comprises:

an adjustable vertical support.

8. The golf swing aid of claim 7, further comprising:

a track support, said track support supporting said curved tracks; and said adjustable vertical support coupled to said track support to support said curved tracks.

9. The golf swing aid of claim 8, further comprising:

a base, said base coupled to said vertical support, said base stabilizing said curved tracks.

10. A golf swing aid for instruction of a proper golf swing, comprising:

a first curved track, said first curved track curved in a shape of a proper backswing and having a first flange;

a second curved track, said second curved track curved in a shape of a proper downswing and having a second flange, said second curved track displaced downwardly and posteriorly from said first curved track;

a track support, said track support supporting said curved tracks;

a third curved track, said third curved track downwardly and posteriorly coupling said first curved track in a continuous manner to said second curved track and said first flange coupled continuously with said second flange;

a headless golf club, said headless golf club having a rolling clevis, said rolling clevis engaging one of said first and second flanges and restricting travel of said headless golf club to said path along said curved tracks;

an adjustable vertical support, said adjustable vertical support coupled to said track support to support said curved tracks at an appropriate height for practicing golf swings; and a base, said base coupled to said adjustable vertical support, said base stabilizing said curved tracks; whereby a golf student can practice proper backswings and downswings to achieve a proper golf swing by engaging and swinging said headless golf club along said curved tracks.

11. A method for developing a proper golf swing, the steps comprising:

providing a first curved track, said first curved track curved in a shape of a proper backswing;

providing a second curved track, said second curved track curved in a shape of a proper downswing, said second curved track displaced downwardly and posteriorly from said first curved track; and providing a third curved track, said third curved track downwardly and posteriorly coupling said first curved track in a continuous manner to said second curved track; whereby a golf student can practice proper backswings and downswings to achieve a proper golf swing.

12. The method for developing a proper golf swing of claim 11, the steps further comprising:

providing a headless golf club, said headless golf club slidably coupled to said curved track; whereby said golf student can practice said proper backswings and downswings by engaging and swinging said headless golf club along said curved tracks.

13. The method for developing a proper golf swing of claim 12, the steps further comprising:

providing said first curved track with said first curved track having a first flange; and providing said second curved track with said second curved track having a second flange; with said first flange coupled continuously with said second flange; whereby said headless golf club engages said first and second flanges to restrict travel of said headless golf club to a path along said curved tracks.

14. The method for developing a proper golf swing of claim 13, wherein the step of providing said headless golf club further comprises:

providing a rolling clevis, said rolling clevis engaging one of said first and second flanges, said rolling clevis restricting travel of said headless golf club to said path along said curved tracks.

15. The method for developing a proper golf swing of claim 14, wherein the step of providing said rolling clevis further comprises:

providing a rolling clevis of minimal weight so that a light pulling pressure on the tracks may easily be maintained during the slow, muscle memory training practice swings allowing full concentration on the muscles and position of the golfer's back.

16. The method for developing a proper golf swing of claim 15, the steps further comprising:

providing a vertical support, said vertical support supporting one of said curved tracks at an appropriate height for said golf student.

17. The method for developing a proper golf swing of claim 16, wherein the step of providing said vertical support further comprises:

providing an adjustable vertical support.

18. The method for developing a proper golf swing of claim 17, the steps further comprising:

providing a track support, said track support supporting said curved tracks; and providing said adjustable vertical support coupled to said track support to support said curved tracks.

19. The method for developing a proper golf swing of claim 18, the steps further comprising:

providing a base, said base coupled to said vertical support, said base stabilizing said curved tracks.

20. A method for developing a proper golf swing, the steps comprising:

providing a first curved track, said first curved track curved in a shape of a proper backswing and having a first flange;

providing a second curved track, said second curved track curved in a shape of a proper downswing and having a second flange, said second curved track displaced downwardly and posteriorly from said first curved track;

providing a track support, said track support supporting said curved tracks;

providing a third curved track, said third curved track downwardly and posteriorly coupling said first curved track in a continuous manner to said second curved track and said first flange coupled continuously with said second flange;

providing a headless golf club, said headless golf club having a rolling clevis, said rolling clevis engaging one of said first and second flanges and restricting travel of said headless golf club to said path along said curved tracks;

providing an adjustable vertical support, said adjustable vertical support coupled to said track support to support said curved tracks at an appropriate height for practicing golf swings; and providing a base, said base coupled to said adjustable vertical support, said base stabilizing said curved tracks; whereby a golf student can practice proper backswings and downswings to achieve a proper golf swing by engaging and swinging said headless golf club along said curved tracks.

* * * * *